US006035831A

United States Patent [19]

Stuber et al.

[11] Patent Number: 6,035,831

[45] Date of Patent: Mar. 14, 2000

[54] FUEL DOSAGE CONTROL PROCESS FOR INTERNAL COMBUSTION ENGINES

[75] Inventors: Axel Stuber, Tamm; Lutz Reuschenbach, Stuttgart; Hans Veil, Eberdingen, all of Germany

[73] Assignee: Robert Bosch GmbH, Stuttgart, Germany

[21] Appl. No.: 08/860,036

[22] PCT Filed: Nov. 15, 1995

[86] PCT No.: PCT/DE95/01596

§ 371 Date: Jun. 9, 1997

§ 102(e) Date: Jun. 9, 1997

[87] PCT Pub. No.: WO96/18811

PCT Pub. Date: Jun. 20, 1996

[30] Foreign Application Priority Data

Dec. 14, 1994 [DE] Germany ..... 44 44 416

[51] Int. Cl.[7] ..... F02M 51/00

[52] U.S. Cl. ..... 123/492; 123/493

[58] Field of Search ..... 123/492, 493

[56] References Cited

U.S. PATENT DOCUMENTS 5,239,974 8/1993 Ebinger et al. ..... 123/492
5,494,019 2/1996 Ogawa ..... 123/492
5,584,277 12/1996 Chen et al. ..... 123/492
5,647,324 7/1997 Nakajima ..... 123/493
5,829,247 11/1998 Zhang ..... 123/478

FOREIGN PATENT DOCUMENTS 0044537 7/1981 European Pat. Off. .
41 15 211 11/1992 Germany .

*Primary Examiner*—John Kwon
*Attorney, Agent, or Firm*—Kenyon & Kenyon

[57] ABSTRACT

A method for influencing fuel metering in an internal combustion engine, in particular in transient operation. In accordance with the method, a correction signal (fTW, kTW) is generated to influence the fuel metering. At least one of the following signals is considered thereby: a signal (QK), which relates to the heat flow through fuel evaporation in the intake section (102); a signal (QAn), which relates to the heat flow between the air flowing through intake section (102) and the wall of intake section (102); a signal (QMot), which relates to the heat flow between the engine block and the wall of intake section (102); a signal (QU), which relates to the heat flow between the air flowing through the engine compartment and the wall of intake section (102). In generating the correction signal (fTW, kTW), a signal (TW) can be determined, which represents the wall temperature of the intake section (102).

13 Claims, 3 Drawing Sheets

FUEL DOSAGE CONTROL PROCESS FOR INTERNAL COMBUSTION ENGINES

FIELD OF THE INVENTION

The present invention is directed to a method for influencing fuel metering in an internal combustion engine.

BACKGROUND INFORMATION

The German Patent No. 41 15 211 discloses an electronic control system for metering fuel in an internal combustion engine. In the known system, a basic injection quantity signal is gated with a transition-compensation signal to adapt the metered fuel quantity in response to acceleration and deceleration. In determining the transition-compensation signal, inter alia a wall-film quantity signal, as well as a series of correction signals are considered.

An object of the present invention is to further improve the known system. In particular, the present invention should make it possible to observe a desired air/fuel ratio with the greatest possible accuracy and in the greatest possible number of operating states of the internal combustion engine.

SUMMARY OF THE INVENTION

The present invention has the advantage of enabling an optimal fuel metering in the dynamic operation of the internal combustion engine.

This is achieved by taking one or a plurality of signals into consideration which describe the heat flow toward or away from the intake section.

In known methods heretofore, setting parameters for the fuel metering entailed finding a compromise between various operating states, e.g., high/low ambient temperature or high/average vehicular speed level. By taking these influences on the wall-film characteristics into consideration, an optimal air/fuel mixture can be achieved for these states in transient operation.

DETAILED DESCRIPTION

Figure 1:
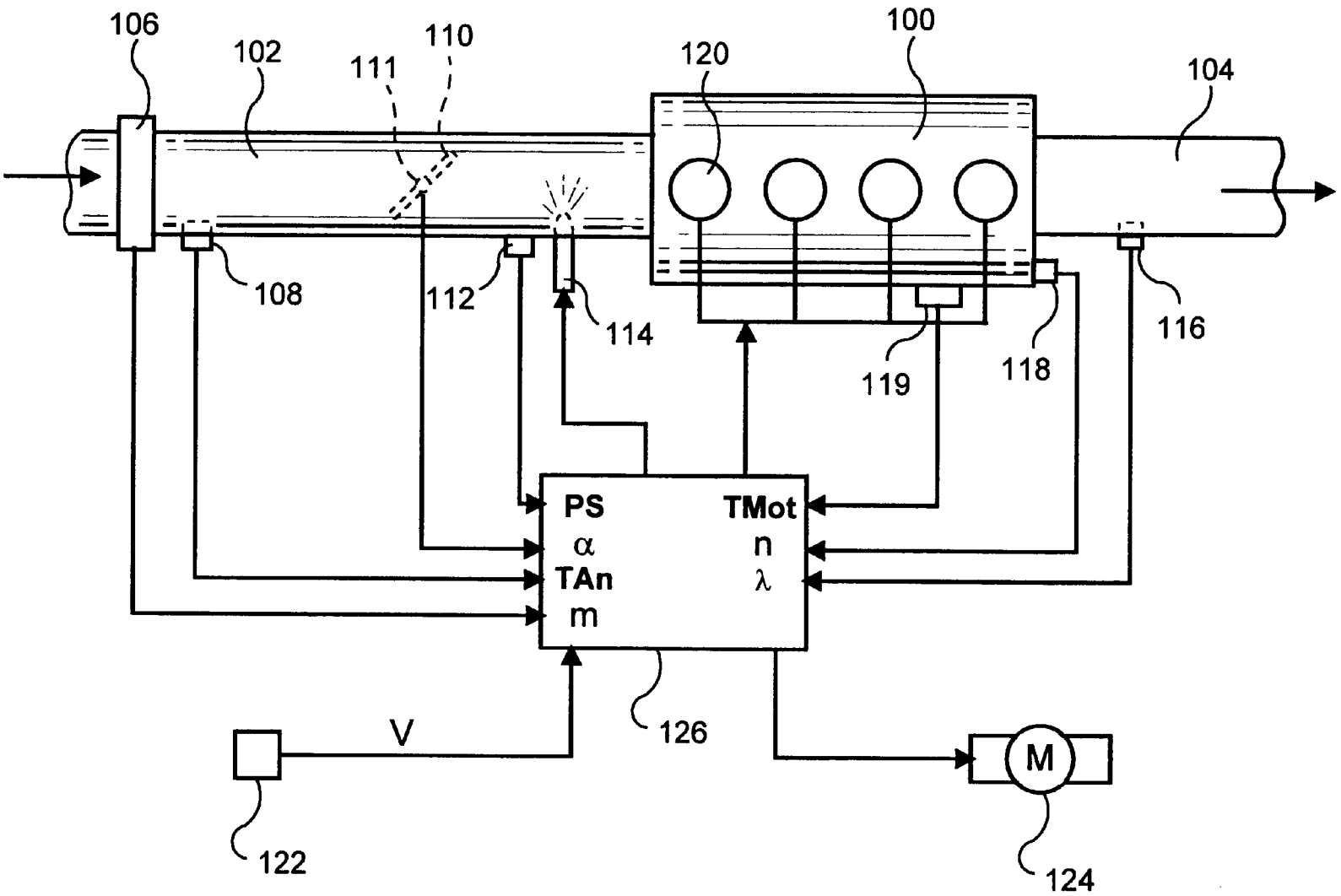
FIG. 1 shows a schematic representation of an internal combustion engine comprising essential components for controlling the fuel metering.

FIG. 1 is a schematic representation of an internal combustion engine 100 and essential components for controlling fuel metering in an open or closed loop. By way of an intake section 102, an air/fuel mixture is supplied to internal combustion engine 100, and the exhaust gases are released into an exhaust duct 104. Viewed in the flow direction of the intake air, mounted in intake section 102 are an air-flow sensor or mass air-flow sensor 106, for example a hot-film air-mass meter, a temperature sensor 108 for detecting intake-air temperature, a throttle valve 110 with a sensor 111 for detecting the opening angle of throttle valve 110, a pressure sensor 112 for detecting the pressure in intake section 102, and at least one injection nozzle 114. As a rule, air-flow sensor or mass air-flow sensor 106, and pressure sensor 112 are alternatively provided. Mounted in exhaust duct 104 is an oxygen probe 116. Mounted on internal combustion engine 100 are an engine speed sensor 118 and a sensor 119 for detecting the temperature of the internal combustion engine. Internal combustion engine 100 has, for example, four spark plugs 120 for igniting the air/fuel mixture in the cylinders. Also shown in FIG. 1 are a sensor 122 for detecting vehicular speed and an electromotor 124, which drives a fan arranged in the engine compartment.

The output signals from the described sensors are transmitted in a central control unit 126. In particular, the signals are: a signal m from air-flow sensor or mass air-flow sensor 106, a signal TAn from temperature sensor 108 for detecting the intake-air temperature, a signal $\alpha$ from sensor 111 for detecting the opening angle of throttle valve 110, a signal PS from pressure sensor 112 downstream from throttle valve 110, a signal $\lambda$ from oxygen sensor 116, a signal n from speed sensor 118, a signal TMot from sensor 119 for detecting the temperature of internal combustion engine 100, and a signal v from sensor 122 for detecting vehicular speed. Control unit 126 evaluates the sensor signals and drives injection nozzle(s) 114 and spark plugs 120. In addition, control unit 126 drives electromotor 124.

As a rule, the device for implementing the method according to the present invention is integrated in control unit 126. with the aid of the method according to the invention, the influence that the wall temperature of the intake section 102 has on the actually metered fuel quantity can be taken into consideration when metering the fuel. There is no need in the method of the present invention for a sensor for detecting wall temperature downstream from injection nozzle(s) 114. Instead—depending on the degree of accuracy required—one or more variables that influence wall temperature are taken into consideration. Using these influence variables as a point of departure, a correction signal fTW or kTW is generated. Correction signal fTW or kTW influences a transition-compensation signal UK, which, in turn, influences a basic injection-quantity signal tp. The transition-compensation signal UK has the property of increasing the metered fuel quantity in response to acceleration and of lowering the metered fuel quantity in response to deceleration.

In accordance with the method of the present invention, correction signal fTW or kTW can either be determined directly from the corresponding influence variables or on the basis of an intermediate variable TW, which represents the wall temperature of intake section 102 and is determined from the influence variables. Considered relevant as influence variables are a heat flow QK generated by the fuel vaporization, a heat flow QAn between the air flowing through intake section 102 and the wall of intake section 102, a heat flow QMot between the engine block and the wall of intake section 102, and a heat flow QU between the ambient air flowing past the outer wall of intake section 102 and the wall of intake section 102. The relation between influence variable TW for the wall temperature of intake section 102 and influence variables QK, QAn, QMot and QU can be represented by the following differential equation:

$$cW*mW*dTW/dt=QK+QAn+QMot+QU$$

In this case, cW represents the specific heat and mW the mass of the wall of intake section 102. The influence variables QK, QAn, QMot and QU are determined from operating parameters and material parameters.

Heat flow QK produced by the fuel vaporization is determined in accordance with the following equation:

$$QK=-qKE*hK*x$$

In this case, qKE represents the fuel quantity metered per unit of time. This variable is, thus, defined by control unit 126. hK represents the specific evaporation heat of the fuel and is a known material constant. x represents the proportion of fuel being deposited on the wall of intake section 102, which fuel subsequently cools the wall of intake section 102 through evaporation. Variable x is stored in an engine characteristics map as a function of speed n and pressure PS in intake section 102.

The heat flow QAn between the air flowing through intake section 102 and the wall of intake section 102 is determined in accordance with the following equation:

$$QAn=\alpha N(m)*(TAn-TW)$$

Here, $\alpha N(m)$ represents the heat transfer coefficient between the air flowing past and the wall of intake section 102 as a function of air-mass flow m.

The heat flow QMot between the engine block and the wall of intake section 102 is determined in accordance with the following equation:

$$QMot=aMot*(TMot-TW)$$

$\alpha Mot$ describes the heat transfer coefficient between the engine block and the wall of intake section 102 and is a material constant.

The heat flow QU between the ambient air flowing past on the outside of intake section 102 and the wall of intake section 102 is a function of the air-mass flow of the ambient air flowing past and of the temperature difference between the ambient air and the wall of intake section 102. The air-mass flow can be determined on the basis of signal v for the vehicular speed and, optionally, of a signal for the operating state of electromotor 124, which drives the fan in the engine compartment. The temperature of the ambient air can be determined using an ambient-temperature sensor (not shown in FIG. 1) or using sensor 108 for intake-air temperature.

The differential equation indicated above can be solved by replacing the time derivation of the wall temperature of intake section 102 by a corresponding difference quotient, i.e., the term dTW/dt is replaced by the term (TWNew−TWOld)/dt. Rearranging according to TWNew, yields the following equation:

$$TWNew=TWOld+(dt/(cW*mW))*(QK+QAn+QMot+QU)$$

In determining the active value TWNew for the wall temperature, a starting value TWStart is initially specified for the wall temperature and the active value TWNew is then determined iteratively from the preceding value TWOld. Relevant details are shown in the flow chart of FIG. 4 and described in the corresponding text.

Figure 2:
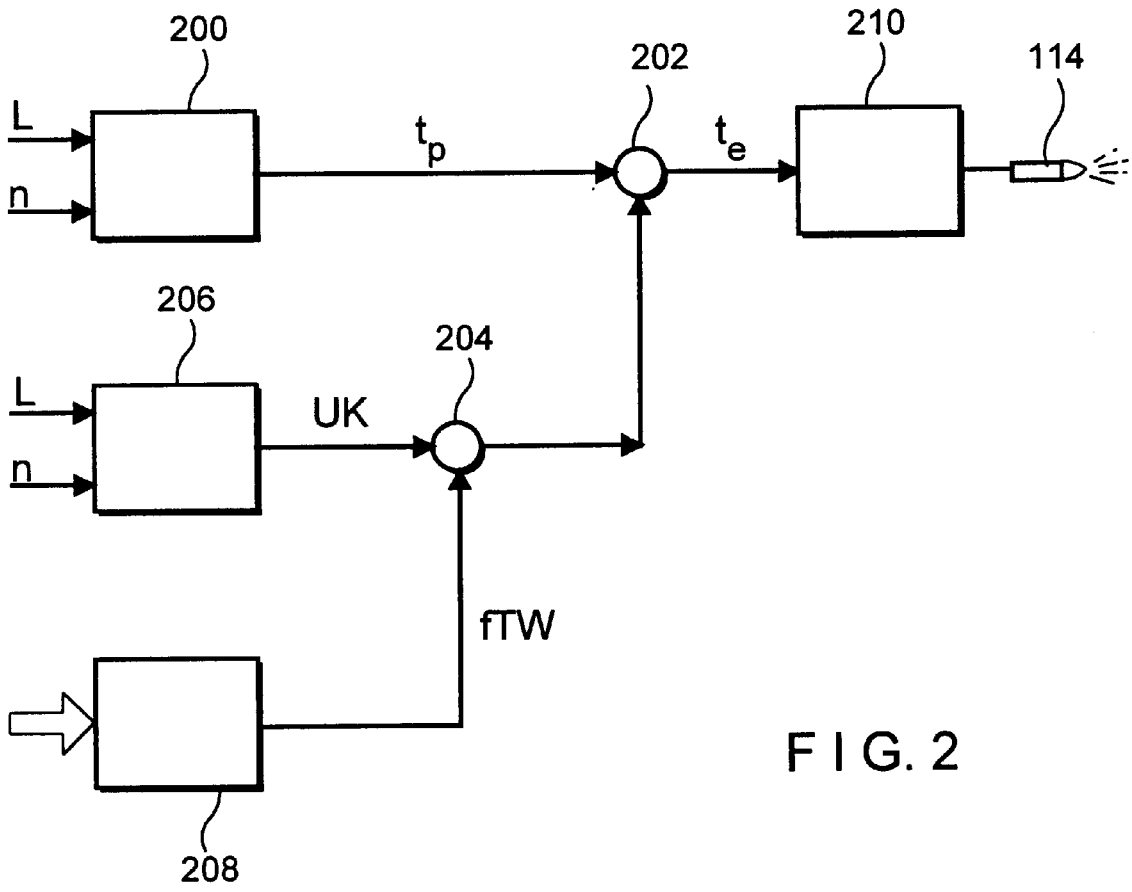
FIG. 2 shows a block diagram for clarifying how the fuel metering is influenced using the method according an embodiment of the present invention.

FIG. 2 shows a block diagram for clarifying how the fuel metering is influenced by the method according to the present invention. A load signal L and a signal n for the speed of internal combustion engine 100 are each fed into one input of a block 200. Load signal L can be determined in a well known manner on the basis of one of the signals m, PS or $\alpha$. A basic injection-quantity signal tp is held ready at the output of block 200. It is generally known from the related art how to determine the basic injection-quantity signal tp from signals L and n. The output of block 200 is linked to a first input of a node 202. The second input of node 202 is linked to the output of a node 204. A first input of node 204 is linked to the output of a block 206 for transition compensation. The second input of node 204 is linked to the output of a block 208, which carries out the method according to the present invention. As a rule, a series of input signals is injected into block 208. What signals these are, in particular, depends upon which of the influence variables QK, QAn, QMot and QU are to be considered. The double arrow pointing at block 208 is representative of all input signals.

Signals L and n for load and speed of internal combustion engine 100 are applied to both inputs of block 206. From these signals, block 206 determines a transition-compensation signal UK for influencing basic injection-quantity signal tp and holds ready signal UK at its output. Signal UK is gated at node 204 with a correction signal fTW, which is output from block 208. The signal generated by the gating at node 204 is gated at node 202 with the basic injection-quantity signal tp to form an injection signal te. Injection signal te is fed to a block 210, where, if indicated, other corrections are made, for example as a function of signal TMot for the temperature of internal combustion engine 100 or of signal $\lambda$ of oxygen sensor 116, and which, in the end, generates a signal for triggering injection nozzle (s) 114.

As illustrated in FIG. 2, the method according to the present invention makes it possible to produce a correction signal fTW, which influences signal UK and, thus, also the basic injection-quantity signal tp. In other words, in the end, correction signal fTW influences the fuel metering. It is already known how to determine signal UK by means of block 206. A corresponding method is described, for example, in German Patent No. 41 15 211.

The block diagram shown in FIG. 2 relates to one of several possible ways of using correction signal fTW, which is produced according to the method of the present invention, to influence the fuel metering. An alternative possibility is depicted in FIG. 3.

Figure 3:
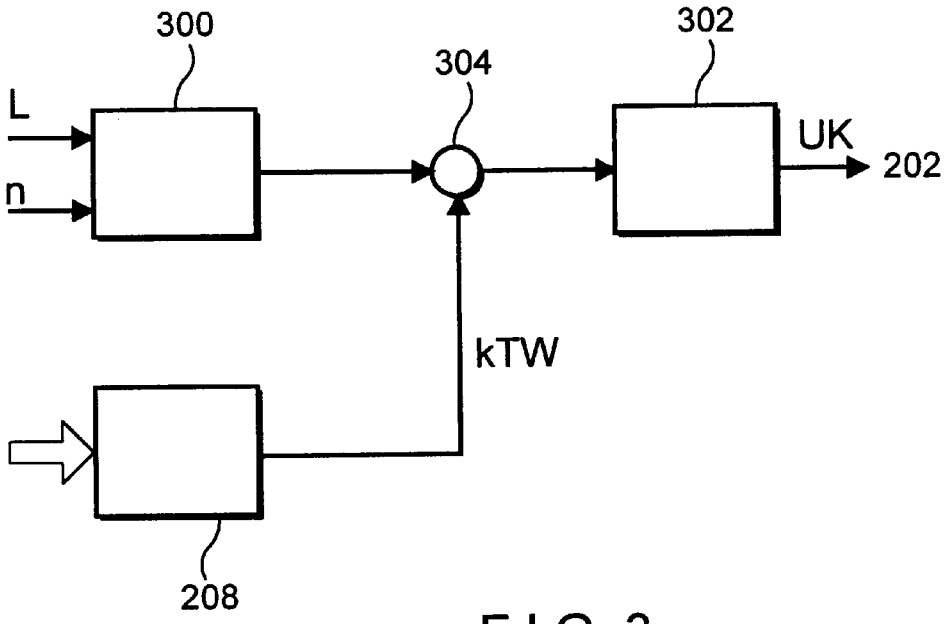
FIG. 3 shows a variant of the block diagram shown in FIG. 2.

FIG. 3 depicts a variant of the block diagram shown in FIG. 2. FIG. 3 illustrates how signal UK is influenced by a correction signal kTW produced using the method of the present invention. The further processing of signal UK follows analogously to FIG. 2 and is not shown in detail in FIG. 3. However, node 204 depicted in FIG. 2 is omitted. Taking the place of block 206 in FIG. 2, are blocks 300 and 302 in FIG. 3 and a node 304 connected therebetween. From signals L and n for the load and for the speed of internal combustion engine 100, which are fed into its two inputs, block 300 determines a signal for altering the wall film of fuel in intake section 102. The thus produced signal is gated at node 304 with a correction signal kTW, which is generated by block 208 using the method according to the present invention. In the final analysis, correction signal kTW has the same effect on the transition-compensation signal UK as correction signal fTW described above, i.e., in both cases, the fuel metering is influenced in the same manner. However, since correction signals fTW and kTW have different kinds of effects on signal UK, as a rule, the correction signals themselves are not identical.

The signal produced from node 304 is fed into the input of block 302, which generates signal UK using a method known from German Patent No. 41 15 211.

Figure 4:
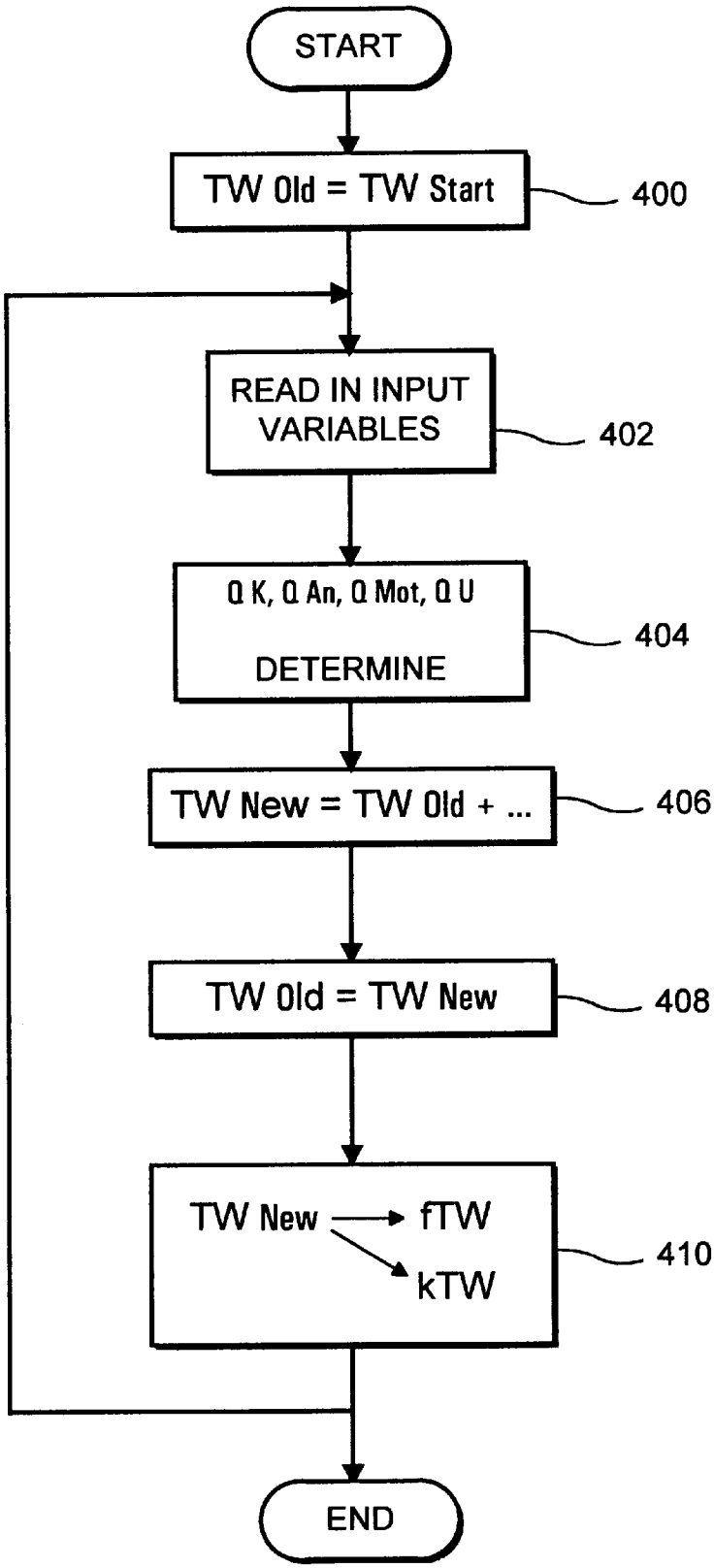
FIG. 4 shows a flow chart of the an embodiment of method according to the present invention.

FIG. 4 depicts a flow chart of the method according to the present invention. In a first step 400, signal TwOld is set to a starting value TWStart. In the subsequent step 402, all input variables required for the method are input. Step 402 is followed by a step 404. Depending on the exemplary embodiment, one or more input variables QK, QAn, QMot and QU are determined in step 404. The equations described further above are used for the particular heat flow. Step 404 is followed by a step 406, in which signal TWNew is determined for the prevailing wall temperature in accordance with the equation already named further above. Depending on the exemplary embodiment, this equation contains one or more of the influence variables QK, QAn, QMot and QU, which represent the individual heat flows. Step 406 is followed by a step 408, where signal TWOld for the preceding wall temperature is set to the value TWNew of the prevailing wall temperature. Step 408 is followed by a step 410. In step 410, from signal TWNew for the prevailing wall temperature, correction signal fTW or kTW is determined for influencing the fuel metering. In this case, correction signal fTW or kTW is read out, for example, as a function of signal TW from a characteristic. The flow chart completes its cycle at step 410 and begins anew at step 402.

What is claimed is:

1. A method for influencing a fuel metering in an internal combustion engine, comprising the steps of:

providing a first signal representing a magnitude of a heat flow caused by a fuel evaporation in an intake section of the internal combustion engine; and generating at least one correction signal, for influencing the fuel metering, as a function of the first signal.

2. The method according to claim 1, further comprising the step of:

considering a second signal, relating to a heat flow between air flowing through the intake section and a wall of the intake section, for generation of the at least one correction signal.

3. The method according to claim 2, further comprising the step of:

determining the second signal based upon a tenth signal relating to a mass air flow through the intake section, and upon a difference between an eleventh signal relating to an intake-air temperature and a twelfth signal relating to a wall temperature of the intake section.

4. The method according to claim 1, further comprising the step of:

considering a third signal, relating to a heat flow between an engine block and a wall of the intake section, for generation of the at least one correction signal.

5. The method according to claim 4, further comprising the step of:

determining the third signal based upon a difference between a thirteenth signal relating to a temperature of the internal combustion engine and a fourteenth signal relating to a wall temperature of the intake section.

6. The method according to claim 1, further comprising the step of:

considering a fourth signal, relating to a heat flow between air flowing through an engine compartment and a wall of the intake section, for generation of the at least one correction signal.

7. The method according to claim 6, further comprising the step of:

determining the fourth signal based upon at least one of a fifteenth signal relating to a vehicular speed, a sixteenth signal relating to an ambient temperature, a seventeenth signal relating to an intake-air temperature, and an eighteenth signal relating to an operating state of a fan in the engine compartment.

8. The method according to claim 1, further comprising the step of:

determining a fifth signal, representing a wall temperature of the intake section, for generation of the at least one correction signal.

9. The method according to claim 1, further comprising the step of:

influencing a sixth signal, by the at least one correction signal, to enrich a fuel mixture in response to an acceleration and to make the fuel mixture lean in response to a deceleration.

10. The method according to claim 9, further comprising the step of:

influencing a seventh signal, by the at least one correction signal, relating to a wall film of fuel in the intake section; and determining the sixth signal based upon the seventh signal.

11. The method according to claim 1, further comprising the step of:

determining the first signal based upon an eighth signal relating to a fuel quantity metered per unit of time, and upon a ninth signal relating to a proportion of fuel deposited on a wall of the intake section.

12. A device comprising:

means for providing a signal representing a magnitude of a heat flow through a fuel evaporation in an intake section of an internal combustion engine; and means for generating at least one correction signal, for influencing a fuel metering in the engine, as a function of the signal.

13. The method according to claim 1, further comprising the steps of:

generating at least a second correction signal as a function of at least one of a temperature of the internal combustion engine and an oxygen content of an exhaust gas of the internal combustion engine; and generating a signal for triggering the fuel metering on the basis of at least the at least one correction signal, the at least second correction signal, and a basic injection-quantity signal.

* * * * *

UNITED STATES PATENT AND TRADEMARK OFFICE

CERTIFICATE OF CORRECTION

PATENT NO. : 6,035,831
DATED : March 14, 2000
INVENTOR(S) : Stuber et al.

It is certified that error appears in the above-identified patent and that said Letters Patent is hereby corrected as shown below:

Col. 57, line 7, delete "section (102); a signal" and insert --section; a signal--

Col. 57, line 9, delete "(102) and the wall" and insert --and the wall--

Col. 57, line 9, delete "section (102); a signal" and insert --section; a signal--

Col. 57, line 11, delete "the wall of intake section" and insert --the wall of the intake section--

Col. 57, line 11, delete "section (102); a signal" and insert --section; a signal--

Col. 57, line 13, delete "wall of intake" and insert --wall of the intake--

Col. 57, line 13, delete "section (102). In" and insert --section. In--

Col. 57, line 16, delete "section (102)." and insert --section.--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*